US012800276B2

(12) United States Patent
Ferguson et al.

(10) Patent No.: US 12,800,276 B2
(45) Date of Patent: Nov. 17, 2026

(54) ARROW SLEEVE WITH FRICTIONAL RETAINING MECHANISM

(71) Applicant: Pro-Tracker IP Holding, LLC, Rexburg, ID (US)

(72) Inventors: Michael D. Ferguson, Rexburg, ID (US); Gary A. Christensen, American Fork, UT (US); Charles T. Green, Oceanside, CA (US)

(73) Assignee: Pro-Tracker IP Holding, LLC, Rexburg, ID (US)

( * ) Notice: Subject to any disclaimer, the term of this patent is extended or adjusted under 35 U.S.C. 154(b) by 180 days.

(21) Appl. No.: 18/421,831

(22) Filed: Jan. 24, 2024

(65) Prior Publication Data

US 2024/0310152 A1 Sep. 19, 2024

Related U.S. Application Data

(60) Provisional application No. 63/528,331, filed on Jul. 21, 2023, provisional application No. 63/471,715, filed on Jun. 7, 2023, provisional application No. 63/440,881, filed on Jan. 24, 2023.

(51) Int. Cl.
*F42B 6/08* (2006.01)

(52) U.S. Cl.
CPC ..... *F42B 6/08* (2013.01)

(58) Field of Classification Search
CPC ..... F42B 6/04; F42B 6/08
USPC ..... 473/578, 582
See application file for complete search history.

(56) References Cited

U.S. PATENT DOCUMENTS

| | | | | | |
|---|---|---|---|---|---|
| 3,401,938 | A * | 9/1968 | Bear | F42B 6/08 | 473/582 |
| 3,868,114 | A * | 2/1975 | Groner | F42B 6/08 | 473/582 |
| 3,910,579 | A * | 10/1975 | Sprandel | F42B 6/08 | 473/584 |
| 4,006,901 | A * | 2/1977 | Simo | F42B 6/08 | D22/115 |
| 4,029,319 | A * | 6/1977 | Christen | F42B 6/08 | 279/42 |
| 4,141,554 | A * | 2/1979 | Sherwin | F42B 6/06 | 473/585 |
| 4,175,749 | A * | 11/1979 | Simo | F42B 6/08 | 473/584 |
| 4,203,601 | A * | 5/1980 | Simo | F42B 6/08 | 473/583 |

(Continued)

FOREIGN PATENT DOCUMENTS

| | | |
|---|---|---|
| CA | 3077865 | 6/2024 |
| JP | 2014074527 | 4/2014 |
| WO | WO2024158945 | 8/2024 |

*Primary Examiner* — Alexander R Niconovich
(74) *Attorney, Agent, or Firm* — Clayton Howarth, P.C.

(57) ABSTRACT

An arrow insert includes a bore configured to receive an arrow point shaft and one or more frictional retaining mechanisms positioned in the bore to increase friction between the insert and the arrow point and reduce loosening during use. In some embodiments, the bore includes a threaded portion, a smooth portion, and an annular setting that receives an O-ring. In further embodiments, a sleeve surrounds a forward portion of the arrow shaft and insert and is secured when the arrow point passes through a distal sleeve bore and threads into the insert.

47 Claims, 13 Drawing Sheets

(56) References Cited

U.S. PATENT DOCUMENTS 4,210,330 A * 7/1980 Kosbab ..... F42B 6/08 473/584
4,381,866 A * 5/1983 Simo ..... F42B 6/08 30/337
4,405,133 A * 9/1983 Cartwright, Jr. ..... F42B 6/08 473/582
4,533,146 A * 8/1985 Schaar ..... F42B 6/04 473/584
4,534,568 A * 8/1985 Tone ..... F42B 6/04 403/164
4,671,517 A * 6/1987 Winters ..... F42B 6/08 403/165
4,706,965 A * 11/1987 Schaar ..... F42B 6/04 473/578
4,943,067 A * 7/1990 Saunders ..... F42B 6/04 473/578
5,094,463 A * 3/1992 Dryden ..... F42B 6/04 473/578
5,269,534 A * 12/1993 Saunders ..... F42B 6/08 473/582
5,306,020 A * 4/1994 Bolf ..... F42B 6/06 473/578
5,354,068 A * 10/1994 Maleski ..... F42B 6/08 473/584
5,417,440 A * 5/1995 Barrie ..... F42B 6/08 473/584
5,496,043 A * 3/1996 Ester ..... F42B 6/08 473/584
5,516,117 A * 5/1996 Rangel ..... F42B 6/04 473/578
5,547,200 A * 8/1996 Rangel ..... F42B 6/04 403/375
5,611,542 A * 3/1997 Saunders ..... F42B 6/08 473/578
5,636,846 A * 6/1997 Tinsley ..... F42B 6/08 473/584
5,902,199 A * 5/1999 Adams, Jr. ..... F42B 6/04 473/578
5,921,875 A * 7/1999 Bickel ..... F42B 6/04 403/299
6,027,421 A * 2/2000 Adams, Jr. ..... F42B 6/08 473/578
6,887,172 B2 * 5/2005 Arasmith ..... F42B 6/08 473/583
6,932,728 B2 * 8/2005 Palomaki ..... F42B 6/04 473/578
7,004,859 B2 * 2/2006 Palomaki ..... F42B 6/08 473/578
7,077,770 B2 * 7/2006 Palomaki ..... F42B 6/04 473/578
7,179,182 B2 * 2/2007 Summers ..... F42B 6/08 473/583
7,207,908 B1 * 4/2007 Gizowski ..... F42B 6/08 473/583
7,485,056 B2 * 2/2009 Sullivan ..... F42B 6/08 473/583
7,651,421 B2 * 1/2010 Smith ..... F42B 6/08 473/582
7,686,714 B2 * 3/2010 Smith ..... F42B 6/04 473/578
7,811,186 B2 * 10/2010 Palomaki ..... F42B 6/08 473/578
7,955,201 B2 * 6/2011 Harwath ..... F42B 6/04 473/585
8,016,703 B1 * 9/2011 Kronengold ..... F42B 6/08 473/582
8,057,330 B2 * 11/2011 Blosser ..... F42B 6/04 473/582
8,075,430 B1 * 12/2011 Hester ..... F42B 12/385 473/578
8,337,341 B1 * 12/2012 Huang ..... F42B 6/08 473/582
8,337,342 B1 * 12/2012 Huang ..... F42B 6/04 473/582
8,403,777 B1 * 3/2013 Huang ..... F42B 6/04 473/582
8,460,134 B2 * 6/2013 Palomaki ..... F42B 6/08 473/582
8,480,520 B2 * 7/2013 Webber ..... F42B 6/08 473/582
8,668,605 B1 * 3/2014 Huang ..... F42B 6/08 473/582
8,784,243 B2 * 7/2014 James ..... F42B 6/08 473/578
8,961,341 B2 * 2/2015 Dickerson ..... F42B 6/08 473/582
9,068,804 B2 * 6/2015 McPherson ..... F42B 6/04
9,341,447 B2 * 5/2016 James ..... F42B 6/08
9,366,510 B1 * 6/2016 Zobell ..... F42B 6/08
9,410,773 B2 * 8/2016 Greenwood ..... F42B 6/08
9,441,927 B1 * 9/2016 Huang ..... F42B 6/08
9,500,452 B1 * 11/2016 Donahoe ..... F42B 12/385
9,638,499 B2 * 5/2017 Perry ..... F42B 6/04
9,658,036 B2 5/2017 Zobell
9,658,037 B2 5/2017 James
9,739,581 B2 * 8/2017 Zobell ..... F42B 6/08
9,772,169 B2 9/2017 Greenwood
9,915,510 B1 * 3/2018 Huang ..... F42B 6/08
10,203,185 B1 * 2/2019 Kitts ..... F42B 6/04
10,634,470 B2 * 4/2020 D'Acquisto ..... F42B 6/08
10,859,354 B1 * 12/2020 Huang ..... F42B 6/08
11,022,413 B1 * 6/2021 Broderick ..... F42B 6/08
11,047,658 B2 * 6/2021 Ferguson ..... F41G 1/467
11,098,994 B1 * 8/2021 Huang ..... F42B 6/08
11,105,594 B2 * 8/2021 Decker ..... A01K 81/04
11,460,278 B2 * 10/2022 Keeney ..... F42B 6/08
11,740,060 B2 * 8/2023 Forrest ..... F42B 6/04 473/583
11,828,581 B1 * 11/2023 Barnett ..... B29C 45/14
11,859,960 B2 * 1/2024 Forrest ..... F42B 6/08
11,885,603 B2 * 1/2024 Haas ..... F42B 6/04
11,982,518 B2 5/2024 Ferguson et al.
12,174,000 B2 * 12/2024 Poston ..... F42B 6/08
12,188,753 B1 * 1/2025 Futtere ..... F42B 6/08
12,241,728 B2 * 3/2025 Ferguson ..... F42B 12/385
12,650,285 B2 * 6/2026 Barnett ..... F42B 6/04
2004/0048704 A1 3/2004 Arasmith
2005/0075203 A1 4/2005 Palomaki et al.
2007/0082766 A1 * 4/2007 Smith ..... F42B 6/04 473/578
2008/0085793 A1 * 4/2008 Palomaki ..... F42B 6/04 473/586
2008/0176681 A1 * 7/2008 Donahoe ..... G06F 3/041 73/488
2009/0075766 A1 3/2009 Ben et al.
2013/0170900 A1 * 7/2013 Bay ..... F16B 13/063 29/428
2017/0045345 A1 * 2/2017 Román ..... F42B 12/38
2017/0067723 A1 * 3/2017 Pedersen ..... B29C 45/0013
2017/0299353 A1 * 10/2017 Greenwood ..... F42B 6/04
2020/0018578 A1 * 1/2020 D'Acquisto ..... F42B 6/08
2020/0263964 A1 * 8/2020 Ferguson ..... F42B 12/385
2021/0080239 A1 * 3/2021 Ferguson ..... F41G 1/467
2023/0213320 A1 * 7/2023 Forrest ..... F42B 6/08 473/583
2025/0020439 A1 * 1/2025 Ferguson ..... F41B 5/1438
2025/0027756 A1 * 1/2025 Gizowski ..... F42B 6/08
2025/0093136 A1 * 3/2025 Poston ..... F42B 6/04

* cited by examiner

| FMJ No. | A | B |
|---|---|---|
| 250 | 7.37 | 7.95 |
| 300 | 6.93 | 7.53 |
| 340 | 6.83 | 7.43 |
| 400 | 6.68 | 7.28 |

1140

ARROW SLEEVE WITH FRICTIONAL RETAINING MECHANISM

CROSS-REFERENCE TO RELATED APPLICATIONS

This application claims the benefit of U.S. Provisional Patent Application No. 63/440,881, filed Jan. 24, 2023, U.S. Provisional Patent Application No. 63/471,715, filed Jun. 7, 2023, and U.S. Provisional Patent Application No. 63/528,331, filed Jul. 21, 2023, which are hereby incorporated by reference herein in their entirety, including but not limited to those portions that specifically appear hereinafter, the incorporation by reference being made with the following exception: In the event that any portion of the above-referenced applications are inconsistent with this application, this application supersedes said above-referenced provisional applications.

STATEMENT REGARDING FEDERALLY SPONSORED RESEARCH AND DEVELOPMENT

Not Applicable.

BACKGROUND

This disclosure relates generally to arrows, and more particularly, to an arrow sleeve or insert for securing an arrowhead or field point to an arrow.

In the construction of an arrow, an arrow point can be secured to an arrow shaft through the use of an arrow insert, which is secured in the front of the arrow and has a threaded bore for an arrow point to be secured into. The arrow point may be either a broadhead or a fieldpoint.

One problem that archers often have is that an arrow point may become loose after a shot. This requires the archer to tighten the field tip after every shot. This can be difficult, especially when discussing a broadhead with sharp vanes making it hard to tighten the tip with the fingers. In addition, an arrow can be damaged by an impact, especially in the forward part of the arrow closest to the impact. What is needed is an insert with a sleeve that more securely holds the arrow point in the insert so that the arrow point does not need to be tightened after every shot, while protecting the forward part of the arrow and preventing damage.

SUMMARY OF THE DISCLOSURE

One illustrative embodiment of the present disclosure may comprise an insert for an arrow which has a threaded bore having one or more frictional retaining mechanisms set within the bore. The frictional retaining mechanism may be within the threaded portion of the bore, or on the edge of the threaded portion of the bore. The frictional retaining mechanism may be comprised of rubber, plastic, or any other material that produces friction to prevent the arrow point from loosening. The frictional retaining mechanism may be comprised of an O-ring. Another embodiment is an arrow outsert having a threaded bore having one or more frictional retaining mechanisms set within the bore. An additional embodiment comprises an arrow insert as above with a sleeve set over the front of the arrow and secured to the front portion of the arrow insert.

BRIEF DESCRIPTION OF THE DRAWINGS

The features and advantages of the disclosure will become apparent from a consideration of the subsequent detailed description presented in connection with the accompanying drawings in which:

FIG. 13C also shows an arrow sleeve with an outer diameter larger than the outer diameter of the arrow.

DETAILED DESCRIPTION

Figure 1:
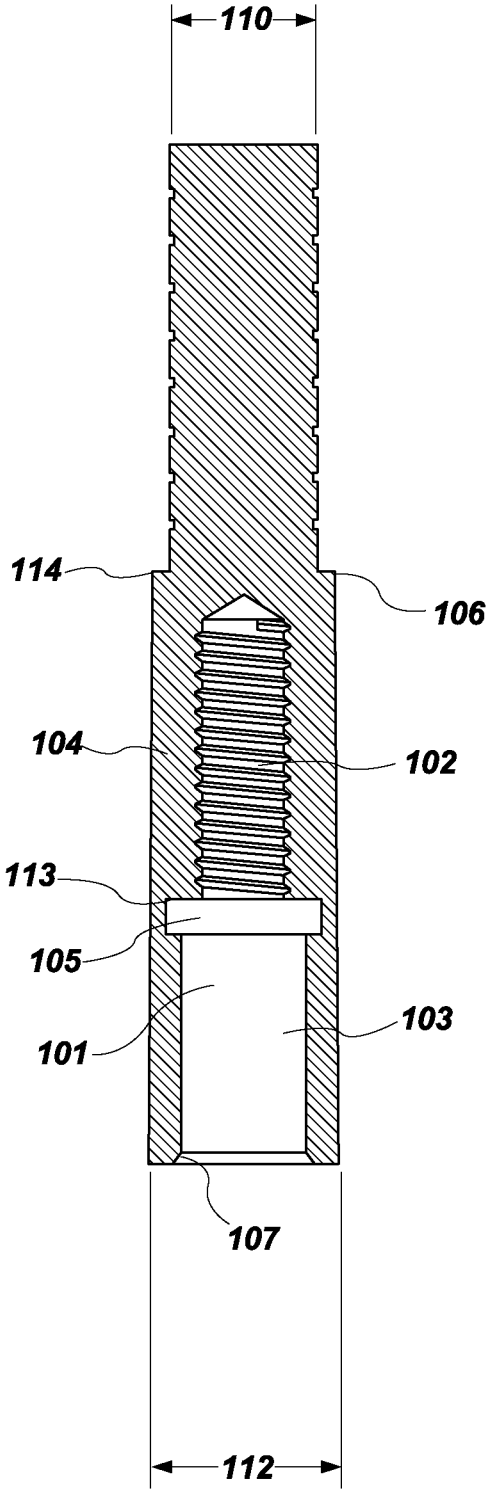
FIG. 1 is a view of one embodiment of an arrow insert with frictional retaining mechanism, showing an arrow insert with a setting for a frictional retaining mechanism.

For the purposes of promoting an understanding of the principles in accordance with this disclosure, reference will now be made to the embodiments illustrated in the drawings and specific language will be used to describe the same. It will nevertheless be understood that no limitation of the scope of the disclosure is thereby intended. Any alterations and further modifications of the inventive features illustrated herein, and any additional applications of the principles of the disclosure as illustrated herein, which would normally occur to one skilled in the relevant art and having possession of this disclosure, are to be considered within the scope of the disclosure claimed.

Before the devices, systems, processes and methods will be disclosed and described, it is to be understood that this disclosure is not limited to the particular configurations, process steps, and materials disclosed herein as such configurations, process steps, and materials may vary somewhat. It is also to be understood that the terminology employed herein is used for the purpose of describing particular illustrative embodiments only and is not intended to be limiting since the scope of the disclosure will be limited only by the appended claims and equivalents thereof.

In describing and claiming the subject matter of the disclosure, the following terminology will be used in accordance with the definitions set out below.

It must be noted that, as used in this specification and the appended claims, the singular forms "a", "an", and "the" include plural referents unless the context clearly dictates otherwise.

As used herein, the terms "comprising," "including," "containing," "characterized by," "having" and grammatical equivalents thereof are inclusive or open-ended terms that do not exclude additional, unrecited elements or method steps.

As used herein, the term "proximal" shall refer broadly to the concept of a nearest portion. For example, the end of the arrow comprising fletching is the proximal-most portion of the arrow, because it is the nearest portion to the shooter as the arrow is traveling toward a target. As such, the "proximal" end of the arrow may also be referred to as the "back" of the arrow.

As used herein, the term "distal" shall generally refer to the opposite of proximal, and thus to the concept of a further portion, or a furthest portion, depending upon the context. For example, the end of an arrow comprising the tip is the distal-most portion of the arrow, because it is the farthest portion to the shooter as the arrow is traveling toward a target. Therefore the "distal" end of an arrow may also be referred to as the "front" of the arrow.

FIG. 1 illustrates one embodiment of an arrow insert with a frictional retaining mechanism. Said arrow insert is designed to fit within an arrow shaft in the distal portion of the arrow shaft. The insert may be secured within the arrow shaft through any manner known in the art. This may include epoxy, glue, or other adhesives used to secure an insert within an arrow shaft. The insert may have a proximal outer diameter 110 and a distal outer diameter 112. The distal outer diameter 112 may be larger than the proximal outer diameter 110. The proximal outer diameter and distal outer diameter may be chosen to give the insert the best fit with the particular arrow shaft being used. By way of example only, in one embodiment the proximal outer diameter 110 may be between 6.17 mm and 6.19 mm while the distal outer diameter 112 may be between 7.6 mm and 7.7 mm. The dimensions shown in FIG. 1 and described herein are meant to be exemplary and not limiting. The arrow insert is dimensioned to best fit within a particular arrow shaft and may be designed for a variety of arrow shafts. The arrow shaft may have any inner diameter that is appropriate for an arrow shaft. The diameter of the insert is designed to fit securely within the arrow shaft. The dimensions may be modified to best fit a particular arrow shaft.

FIG. 1 also shows the bore 101 set within the distal end of the insert 100. This bore 101 is sized to receive a shaft of an arrow point, whether a field point or broadhead. The bore 101 may comprise a threaded portion 102 and a smooth portion 103. The threaded portion 102 and smooth portion 103 together may be shaped to receive the shaft of an arrow point, wherein an arrow point may be a field tip, a broadhead, or another type of point designed for an arrow. In one exemplary embodiment, the threaded portion 103 may be a 8-32 standard threading and may be 12 mm deep from the end of the smooth portion 103. In another embodiment, the threaded portion may have a 6-40 thread. In another embodiment, the threading may be configured to fit any threading on an arrow point (whether broadhead or field point). In one exemplary embodiment the smooth portion may be approximately 11.2 mm deep with an inner diameter of approximately 5.16 mm.

The bore may also comprise a setting 105 wherein a section of the interior wall of the bore is shaped to receive a frictional retaining mechanism. In one embodiment, the setting 105 may be a ring around the interior of the bore. In one embodiment the setting 105 may comprise a section of the bore with an inner diameter greater than that of the smooth portion of the bore. In one exemplary embodiment, the setting may have a diameter of approximately 6.5 mm. In one embodiment, the frictional retaining mechanism may be a ring of any material that will produce friction between the retaining mechanism and the metallic arrow point. The frictional retaining mechanism may be made of plastic, rubber, or another material that produces friction. In one exemplary embodiment, the frictional retaining mechanism comprises an O-ring.

In one embodiment, the setting 105 and frictional retaining mechanism are set in the bore 101 at the transition between the threaded portion 102 and the smooth portion 103. In one exemplary embodiment the setting 105 may be between about 0.5 mm and about 4 mm wide. In another exemplary embodiment the setting is about 1.5 mm wide. In yet another exemplary embodiment, the setting is about 3.2 mm wide. The setting may be any size appropriate to fit a given frictional retaining mechanism, and the setting out of specific dimensions is not meant to limit the possible size of the setting other than showing examples of possible sizes to fit a frictional retaining mechanism. The diameter of the setting may be of an appropriate size for the frictional retaining mechanism to securely fit within the setting. The frictional retaining mechanism is sized to fit within the setting. In one exemplary embodiment the setting comprises an area wherein the inner diameter of the bore is expanded from about 5.16 mm to about 6.5 mm.

Still referring to FIG. 1, in one exemplary embodiment, one or more settings are set within the threaded portion of the bore. A frictional retaining mechanism is sized to fit within each setting. In another embodiment, one or more settings 105 are within the threaded portion of the bore or the unthreaded portion of the bore, with each setting having a frictional retaining mechanism.

The frictional retaining mechanism may have an inner diameter such that when it is inserted into the setting and the shaft of an arrow point is inserted into the bore and secured within the threaded portion of the bore, the frictional retaining mechanism comes into physical contact with the shaft of the arrow point. This causes friction between the shaft of the arrow point and the frictional retaining mechanism, which is secured within the setting 105. This provides additional friction to the shaft of the arrow point, and prevents the arrow point from becoming loose. The frictional retaining mechanism may be secured in the setting 105 by any means known in the art, such as adhesives, friction with the setting itself 105, or simply due to the shape of the setting 105 keeping the frictional retaining mechanism within it.

Moreover, in the present disclosure particular dimensions of the illustrated embodiments are provided herein to ensure that the illustrated embodiments can be readily made and used by those skilled in the art. However, none of the provided particular dimensions are meant to be limiting but only exemplary.

In one embodiment, the distal end 107 of the insert may be beveled around the bore. This helps allow the shaft of an arrow point to be inserted into the bore. The insert itself may take a variety of different shapes. As shown in FIG. 1, the insert may have a tapered section between the distal end and the proximal end of the insert. A distal diameter 112 of the insert may be chosen to best fit into the arrow shaft. In one exemplary embodiment seen in FIG. 1, the distal diameter 112 of the insert may be approximately 7.95 mm. The tapered section 104 may begin with a first diameter 113 equal to the distal diameter of the insert. In one embodiment the first diameter of the tapered section may be about 7.95 mm. The tapered section then tapers to a second diameter 114. In one exemplary embodiment the second diameter 114 of the tapered section is between about 7.6 mm and about 7.7 mm. In another exemplary embodiment, the proximal diameter 110 of the insert is not equal to the second diameter of the tapered section, but is smaller, there being a stepped portion 106 between the tapered section of the insert and the proximal section of the insert. In one exemplary embodiment, the proximal diameter 110 of the insert is approximately 6.17 mm to approximately 6.19 mm.

Figure 2:
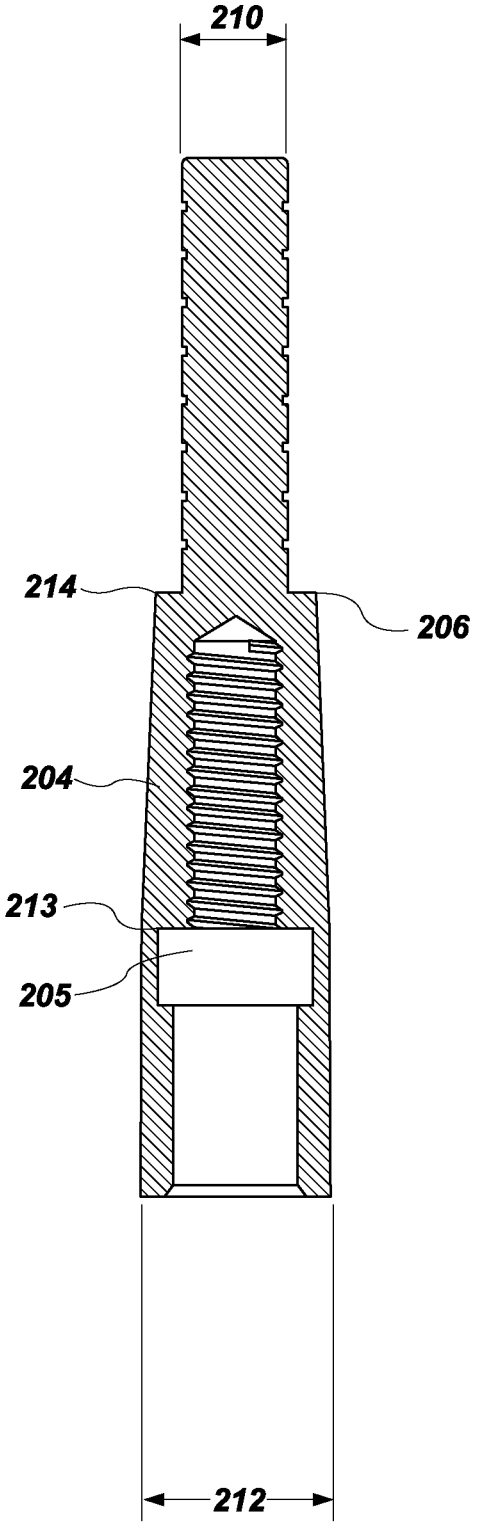
FIG. 2 is a view of a second embodiment of an arrow insert with frictional retaining mechanism, showing a larger setting for a frictional retaining mechanism, also showing a tapered surface on the insert.

FIG. 2 shows a second embodiment of an insert with frictional retaining mechanism where the tapering is more pronounced. A distal diameter 212 of the insert may be chosen to best fit into the arrow shaft. In the exemplary embodiment seen in FIG. 2, the distal diameter 212 of the insert may is still approximately 7.95 mm. The tapered section 204 may begin with a first diameter 213 equal to the distal diameter of the insert. In an exemplary embodiment the first diameter of the tapered section may be 7.95 mm. The tapered section then tapers to a second diameter 214. In one exemplary embodiment the second diameter 214 of the tapered section is between about 6.4 mm and about 6.5 mm. In an exemplary embodiment of an arrow insert with frictional retaining mechanism, the proximal diameter 210 of the insert is not equal to the second diameter of the tapered section, but is smaller, there being a stepped portion 206 between the tapered section of the insert and the proximal section of the insert. By way of example, and not limiting the disclosure, the proximal diameter 210 of the insert may be approximately 4.20 mm to approximately 4.22 mm. In another exemplary embodiment the proximal diameter 210 is between approximately 4.19 mm and approximately 4.21 mm. The dimensions shown in FIG. 2 and described herein are meant to be exemplary and not limiting. The arrow insert is dimensioned to best fit within a particular arrow shaft and may be designed for a variety of arrow shafts. The dimensions may be modified to best fit a particular arrow shaft. The arrow shaft may have any inner diameter that is appropriate for an arrow shaft.

FIG. 2 also shows a setting 205 that may have a greater width. The exemplary setting 205 shown in FIG. 2 may have a width of approximately 3.2 mm wide. In another embodiment, the setting may have a width of about 1.5 mm. In one embodiment, a frictional retaining mechanism may be set within the setting. In another embodiment, two or more frictional retaining mechanisms may be set in the setting. The frictional retaining mechanisms may comprise rubber, plastic, or another material that provides additional friction to the shaft of an arrow point. In one embodiment, the frictional retaining mechanism comprises one, two, or more O-rings.

Figure 3:
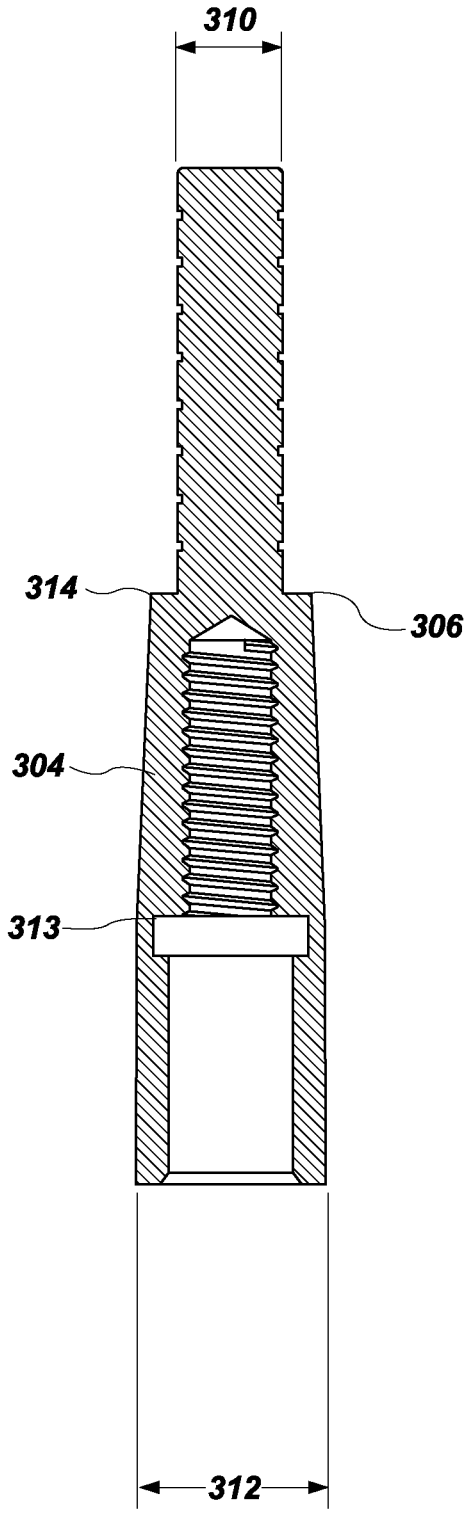
FIG. 3 is a view of a third embodiment of an arrow insert with frictional retaining mechanism, showing a setting for a frictional retaining mechanism, also showing a tapered surface on the insert.

FIG. 3 shows yet a third exemplary embodiment of an insert with frictional retaining mechanism. A distal diameter 312 of the insert may be chosen to best fit into the arrow shaft. In the exemplary embodiment seen in FIG. 3, the distal diameter 312 of the insert is still approximately 7.95 mm. In an exemplary embodiment, the tapered section 304 may begin with a first diameter 313 equal to the distal diameter of the insert. In one embodiment the first diameter of the tapered section may be about 7.95 mm. The tapered section then tapers to a second diameter 314. In another exemplary embodiment the second diameter 314 of the tapered section is between about 6.6 mm and about 6.7 mm. In one embodiment the proximal diameter 310 of the insert is not equal to the second diameter of the tapered section, but is smaller, there being a stepped portion 306 between the tapered section of the insert and the proximal section of the insert. An exemplary embodiment shown in FIG. 3 has the proximal diameter 310 of the insert is approximately 4.17 mm to approximately 4.19 mm. The dimensions shown in FIG. 3 and described herein are meant to be exemplary and not limiting. The arrow insert is dimensioned to best fit within a particular arrow shaft and may be designed for a variety of arrow shafts. The dimensions may be modified to best fit a particular arrow shaft.

Figure 4:
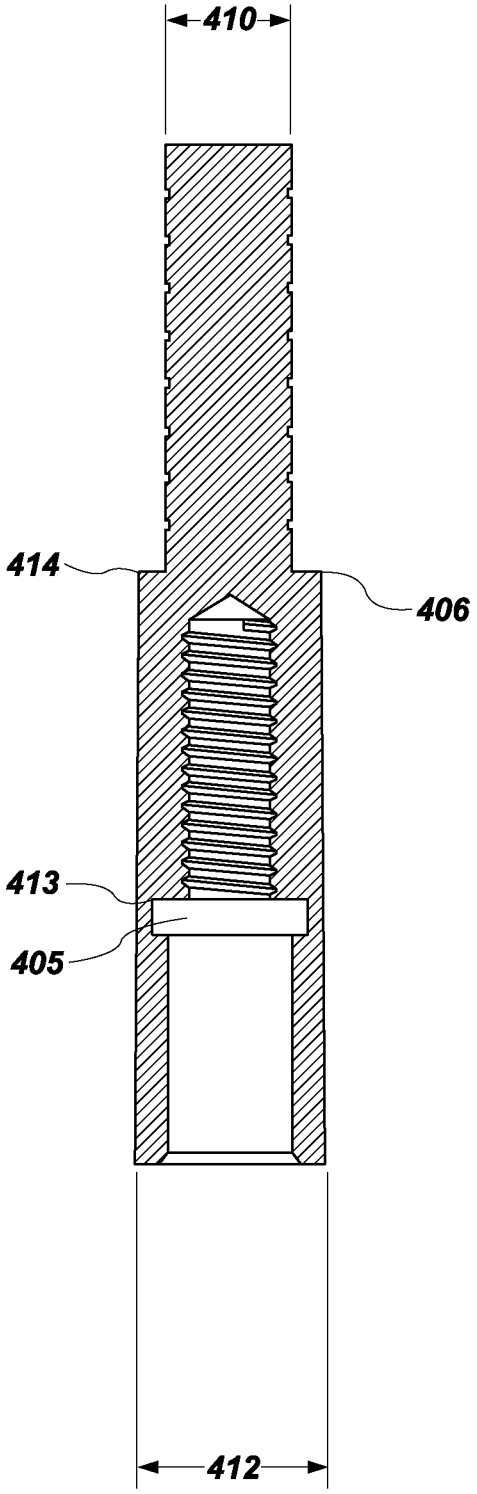
FIG. 4 is a view of a fourth embodiment of an arrow insert with frictional retaining mechanism, showing a setting for a frictional retaining mechanism, which may have a slightly tapered surface on the insert.

FIG. 4 shows additional exemplary embodiments of an insert with frictional retaining mechanism. A distal diameter 412 of the insert may be chosen to best fit into the arrow shaft. In the embodiment seen in FIG. 3, the distal diameter 412 of the insert is still approximately 7.95 mm. While this diameter is shown as 7.95 mm, it may be modified to fit a particular arrow shaft and arrow point. In one exemplary embodiment, the tapered section may begin with a first diameter 413 equal to the distal diameter of the insert. In one embodiment the first diameter of the tapered section may be 7.95 mm. The tapered section then tapers to a second diameter 414. In an exemplary embodiment, the second diameter 414 of the tapered section is between approximately 6.68 mm and approximately 7.37 mm. In other exemplary embodiments, the second diameter of the tapered section varies depending upon the arrow it is to be fit in. In one exemplary embodiment this second diameter 414 is approximately 7.37 mm. Another exemplary embodiment sets this second diameter 414 at approximately 6.93 mm. In a third exemplary embodiment the second diameter 414 is approximately 6.83 mm. A fourth exemplary embodiment has a second diameter as approximately 6.68 mm. In one embodiment the proximal diameter 410 of the insert is not equal to the second diameter of the tapered section, but is smaller, there being a stepped portion 406 between the tapered section of the insert and the proximal section of the insert. In one exemplary embodiment, the proximal diameter 410 of the insert is between approximately 5.16 mm to approximately 5.18 mm. The dimensions shown in FIG. 4 and described herein are meant to be exemplary and not limiting. The arrow insert is dimensioned to best fit within a particular arrow shaft and may be designed for a variety of arrow shafts. The dimensions may be modified to best fit a particular arrow shaft.

Figure 5:
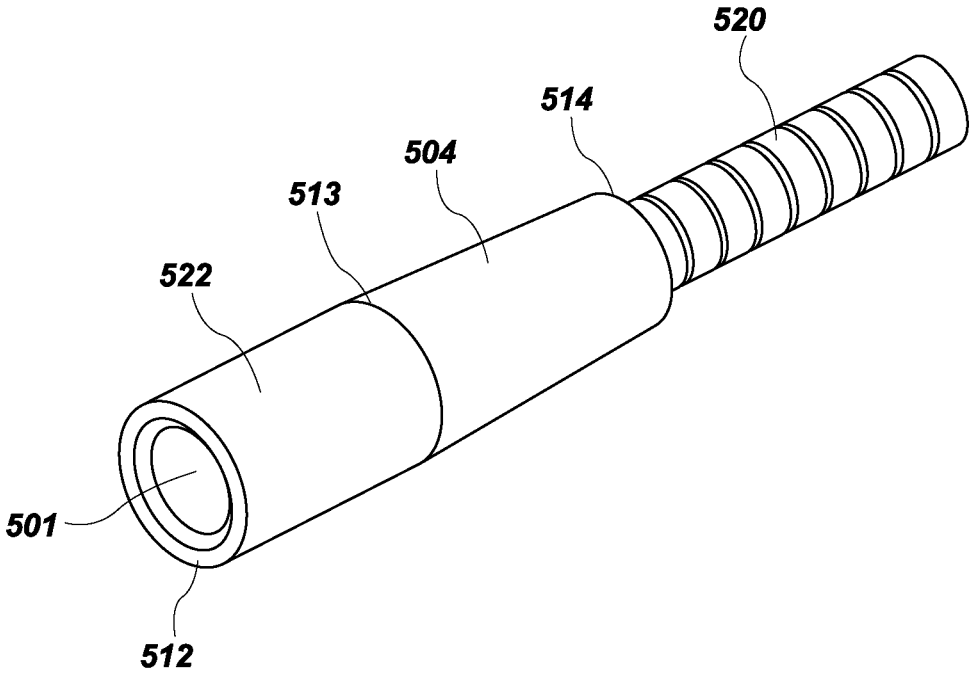
FIG. 5 is a view of the outside of an arrow insert with frictional retaining mechanism, showing a bore to receive the shaft of an arrow point, a tapered section, and a narrower proximal section.

FIG. 5 shows one embodiment of an arrow insert having a frictional retaining mechanism. The insert has a bore 501, comprising a smooth portion and a threaded portion. The insert also comprises a distal section 503 having a constant diameter until reaching a distal end 513 of the tapered section 504. The diameter then decreases until reaching the proximal end 514 of the tapered section 504. At the proximal end 514 of the tapered section 504, there is a stepped portion where the proximal end 520 meets the tapered portion 504. The proximal end 520 has a diameter smaller than that of either part of the tapered section 504.

Figure 6:
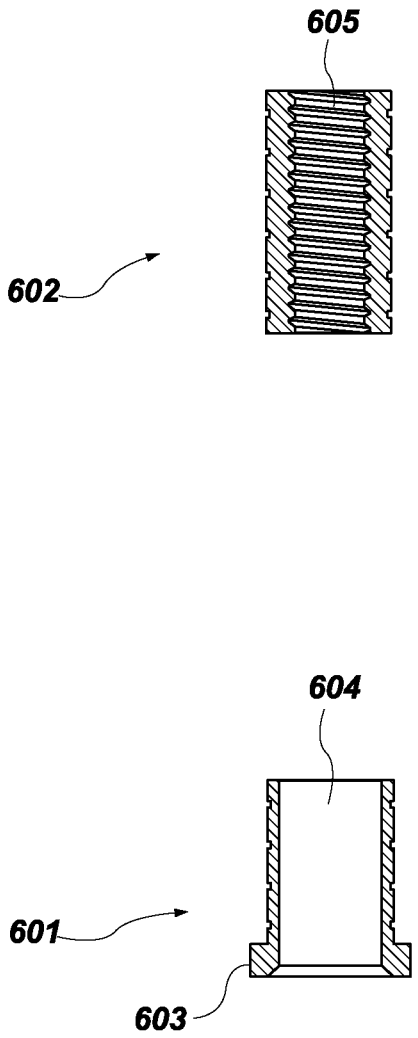
FIG. 6 shows one embodiment of a two-piece arrow insert with frictional retaining mechanism having a top piece and a bottom piece, wherein the bottom piece fits into the top piece, showing the top and bottom pieces separated from one another.

FIG. 6 shows an additional embodiment of an arrow insert having a frictional retaining mechanism. FIG. 6 shows a two piece arrow insert with frictional retaining mechanism comprising a top piece 601 and a bottom piece 602. In one embodiment the top piece 601 may comprise a lip 603 around a bore 604 going through the center of the top piece 601. In one exemplary embodiment the lip has a diameter of approximately 7.95 mm, while the outer diameter of the top piece is approximately 6.2 mm. In one exemplary embodiment, the bottom piece 602 may have a threaded bore going through the center of the bottom piece 602. The threaded bore may be threaded to have any threading appropriate to receive the threaded portion of an arrow point. In one embodiment, the threading may be standard 8-32 threading. In another embodiment the threading may be 6-40 threading. In another embodiment the threading is designed to fit the particular arrow point (whether broadhead or fieldpoint). In one embodiment the bottom piece 602 has an outer diameter that fits snugly into the inner diameter of the top piece 601. In one embodiment, a frictional retaining mechanism may be secured to the top of the bottom piece 602. The bottom piece 602 having the frictional retaining mechanism may be secured to the top of the bottom piece 602. The bottom piece 602 having the frictional retaining mechanism may be secured within the top piece 601 through any means known in the art. This may include glue or other adhesives, a compression fit, or the top portion of the bottom piece 602 may be threaded to fit into threading on the inner portion of the top piece.

Figure 7:
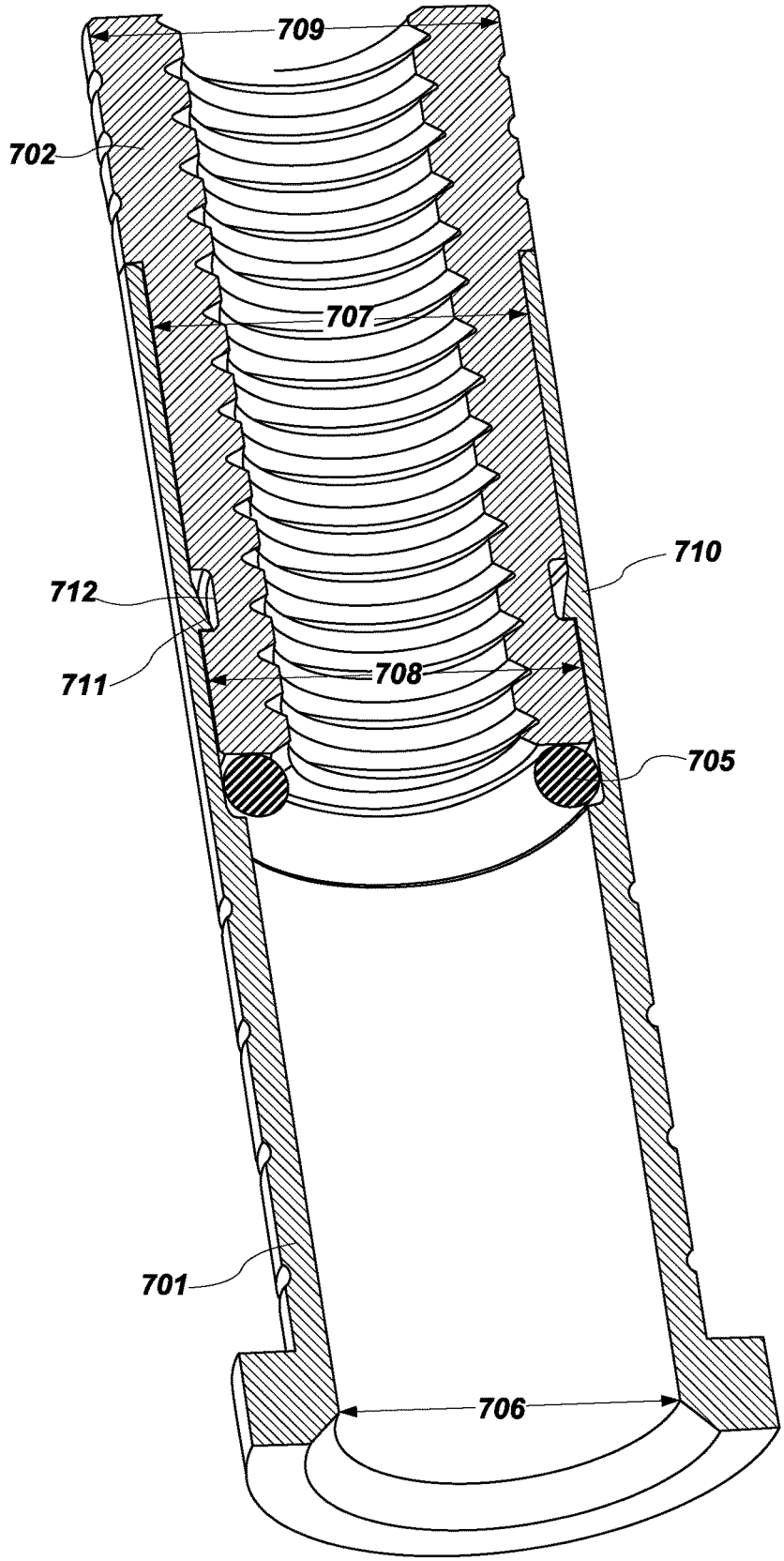
FIG. 7 shows one embodiment of a two-piece arrow insert with frictional retaining mechanism having a top piece and a bottom piece, showing the top and bottom piece joined together and showing the frictional retaining mechanism at the distal end of the bottom piece, also showing the mechanism for securing the top piece to the bottom piece.

FIG. 7 shows a cutaway section of one embodiment of a two piece arrow insert with frictional retaining mechanism. FIG. 7 shows one means of securing the top piece 701 to the bottom piece 702. FIG. 7 also shows the frictional retaining mechanism 705 located at proximal end of the bottom piece 702. In one embodiment, the top piece may have a first inner diameter 706 and a second inner diameter 707. The first inner diameter 706 is located at the distal end of the top piece and may be sized and configured to receive an un-threaded portion of the shaft of an arrow point. The second inner diameter 707 is located at the proximal end of the top piece and is sized and configure to receive the bottom piece 702 of the arrow insert. The bottom piece 702 has a first diameter 708 at the distal end of the piece and a second diameter 709 at the proximal end of the bottom piece 702. The first diameter 708 is sized and configured to fit within the second inner diameter 707 of the top piece 701. In one embodiment, the second diameter 709 is configured to be equal to the outer diameter of the top piece 701. There is also a means for securing the top piece to the bottom piece 710. In one embodiment, shown in FIG. 7, the means of securing 710 the top piece to the bottom piece may comprise a ridge 711 in the top piece and a groove 712 in the bottom piece. The ridge 711 may be shaped as shown in FIG. 7 such that it has an incline on the proximal side of the ridge and a vertical edge on the distal end of the ridge. This allows the ridge to slide into the groove when being secured, but keeps the ridge 711 securely within the groove 712. In one embodiment this ridge 711 and groove 712 are present throughout the entire circumference of the top and bottom pieces. In another embodiment, the ridge and groove may be replaced with threading on the top and bottom piece and the top and bottom piece may be secured to each other by threadedly engaging them. In another embodiment, the top and bottom piece may have small ridges designed to hold an adhesive, such as glue. In other embodiment, the top and bottom pieces may be secured to each other by any means known in the art.

Figure 8A:
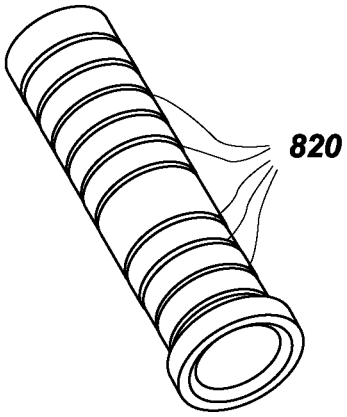
FIG. 8 shows an embodiment of an arrow insert with frictional retaining mechanism, showing an arrow insert having grooves on the exterior to help secure the arrow insert within the shaft of an arrow using an adhesive, also having a threaded section of the arrow insert going through the entire threaded portion of the arrow insert and the bore going entirely through the arrow insert.
Figure 8B:
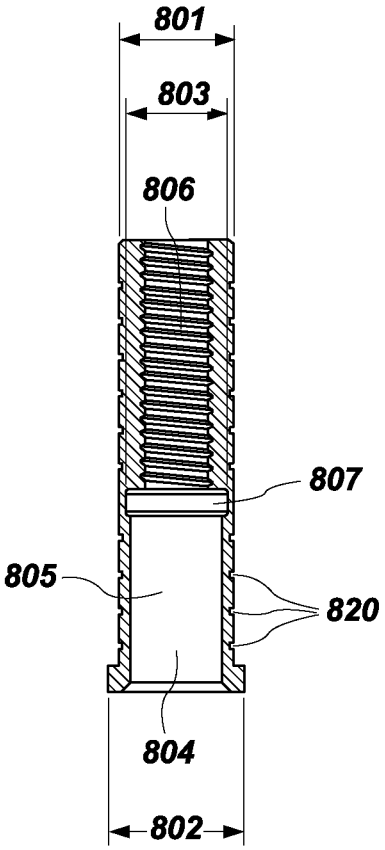

FIG. 8 shows an additional embodiment of an arrow insert with frictional retaining mechanism. In one embodiment, the arrow insert may comprise several grooves 820 on the outer edge of the arrow insert. In one embodiment the grooves may serve to hold adhesive in place so that the arrow insert may be secured within the shaft of an arrow using adhesive. In one embodiment, shown in FIG. 8, the insert may have a single uniform outer diameter 801, save for a lip 802 on the distal end of the arrow insert. In another embodiment, the arrow insert may comprise grooves 820 on the outer surface of the insert. In one illustrative embodiment, the lip 802 may have an outer diameter of approximately 7.5 mm. In another illustrative embodiment, the lip may have a diameter that is of any diameter appropriate to secure the arrow insert at the distal end of an arrow shaft. In an illustrative embodiment, the outer diameter of the arrow 801 insert may be between approximately 6.2 mm and 6.22 mm, while the interior of the grooves may have a diameter 803 of 5.7 mm. In another embodiment, the outer diameter 801 of the arrow insert is configured to fit snugly within the inner diameter of an arrow shaft, to allow the arrow insert to be secured within the arrow shaft. As such, the outer diameter 801 may vary as is appropriate for a wide variety of sizes of arrow shaft (but should nonetheless be of an appropriate size for an arrow shaft). In one embodiment, the arrow insert comprises a bore 804 through the entire insert. The distal end of the bore 805 is smooth, while the proximal end of the bore 806 is threaded. In one embodiment, the frictional retaining mechanism 807 is positioned at the point in the bore just in front of the threaded portion of the bore 806 within the smooth portion of the bore 805. In one embodiment the inner diameter of the bore is enlarged at this point in order to accommodate the frictional retaining mechanism 807. In one illustrative embodiment, the inner diameter of the smooth portion of the bore 805 may be approximately 5.16 mm, while the threaded portion of the bore 806 may have 8-32 threading through the entire threaded portion of the bore 806. In another embodiment the thread may be 6-40 thread. In yet another embodiment, the threading may be of any size appropriate to fit the threaded portion of the shaft of an arrow point. In one embodiment, the bore 804 goes entirely through the arrow insert. In one embodiment, the frictional retaining mechanism 807 may be a ring of material designed to increase friction to the shaft of an arrow point when the arrow point is secured within the arrow insert. The frictional retaining mechanism 807 may be formed out of wood, plastic, rubber, or any other appropriate material. In one embodiment, the frictional retaining mechanism is an O-ring. In another embodiment there may be no groove on the outer surface of the arrow insert in the location of the frictional retaining mechanism.

Figure 9:
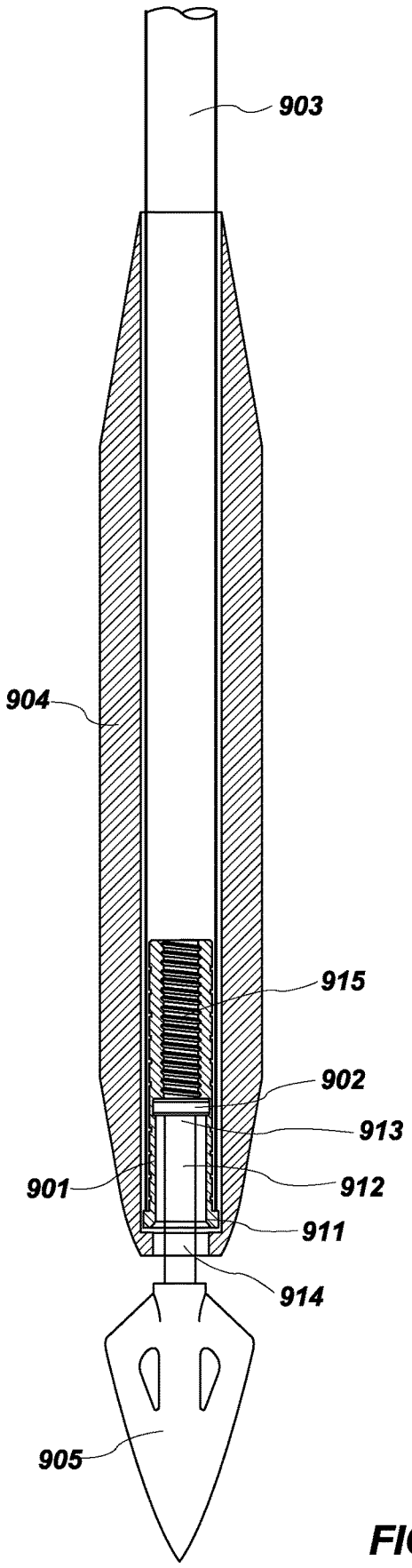
FIG. 9 shows one embodiment of an arrow insert with frictional retaining mechanism secured within the shaft of an arrow, having an arrow sleeve over the top of the arrow insert and the arrow shaft which helps prevent breakage of the arrow insert or the arrow shaft.

Another embodiment of an arrow insert with frictional retaining mechanism is shown in FIG. 9. FIG. 9 shows an embodiment of an arrow insert 901 with frictional retaining mechanism 902. FIG. 9 shows the arrow insert 901 located within an arrow shaft 903 having an arrow sleeve 904 placed over the top of the arrow shaft and the top of the arrow insert 901. The arrow insert 901 is configured such that the outer diameter 911 allows for the arrow sleeve 904 to be placed over the top of the insert 901. In one embodiment, the sleeve 904 placed over the insert 901 on the arrow shaft 903 may be secured by securing an arrow point 905 into the bore 912 of the arrow insert. In one embodiment, a sleeve 904 may be secured to an arrow shaft 903 having an arrow insert 901 by placing the sleeve 904 over the arrow shaft 903 with arrow insert 901 secured within the arrow shaft and threadedly engaging a threaded shaft 913 of an arrow insert through a bore in the sleeve 914 with the threaded bore 915 of the arrow insert.

In one embodiment, the arrow insert is also configured to have a sleeve placed over the top of the arrow and arrow insert so that an arrow point secured to the arrow insert through a bore in the sleeve also secures the sleeve to the arrow. In one embodiment, the sleeve comprises a proximal bore at the proximal end of the sleeve to receive a shaft of an arrow and a narrower distal bore at the distal end of the sleeve which allows the shaft of the arrow point to pass through and be secured within the bore in the insert. In one embodiment, the narrower bore at the distal end of the sleeve is sufficiently narrow that the arrow shaft cannot pass through it, but the shaft of the arrow point can pass through and be secured within the arrow insert, thus securing the sleeve to the arrow shaft and arrow insert. In an embodiment of a method for securing an arrow point to the shaft of an arrow, the method also comprises securing a sleeve over the insert and the shaft of the arrow. In one embodiment, the arrow sleeve is secured over the insert and the shaft of the arrow by securing the arrow point into the insert by securing the shaft of the arrow point within the bore of the insert through a distal bore in the distal end of the arrow sleeve. In one embodiment, the bore in the distal end of the arrow sleeve is small enough that the arrow shaft cannot pass through, but large enough that the shaft of the arrow point can pass through and secure it over the insert and the shaft of the arrow. In one embodiment, the arrow sleeve is secured to the arrow shaft only by the arrow point.

Figure 10:
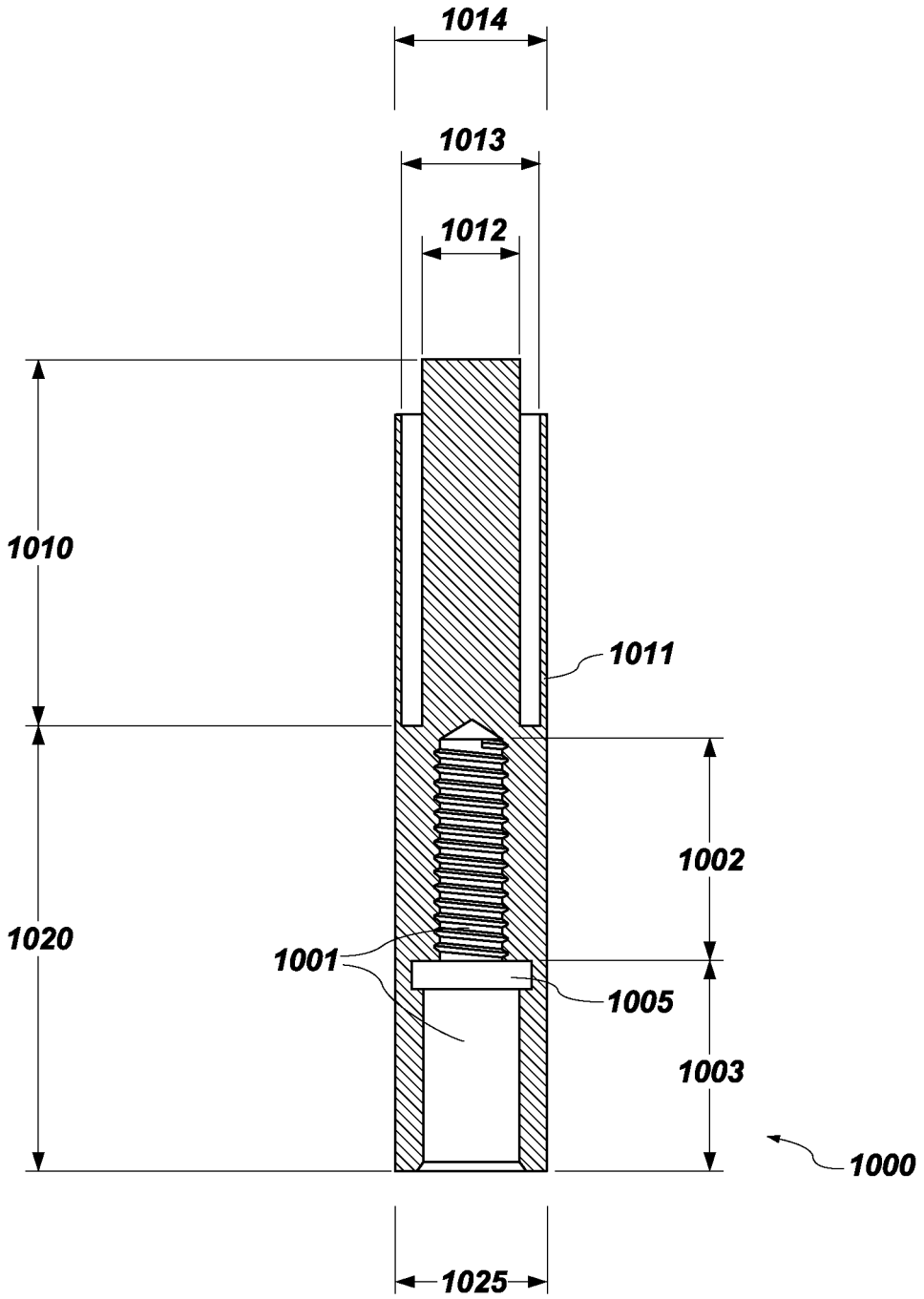
FIG. 10 shows one embodiment of an arrow insert with frictional retaining mechanism having an integrated sleeve to protect the front of the arrow.

FIG. 10 shows another embodiment of an arrow insert with frictional retaining mechanism. FIG. 10 shows an arrow insert with a built-in sleeve. In this embodiment, the arrow insert 1000 has a built-in sleeve 1011 which fits over the top of the arrow shaft on a proximal portion of the arrow insert 1010. In one embodiment, the insert is designed with a proximal inner diameter 1012 which is configured to fit within the inner diameter of an arrow shaft. In one embodiment the proximal inner diameter 1012 may be between approximately 5.16 mm and approximately 5.18 mm. The insert has a built in sleeve 1011 having an inner sleeve diameter 1013 and an outer sleeve diameter 1014. The inner sleeve diameter 1013 is configured to fit over the outer diameter of an arrow shaft when the arrow shaft is placed over the proximal inner diameter 1012 of the insert. In one exemplary embodiment, the inner sleeve diameter may be between approximately 6.5 mm and 7.5 mm. In another exemplary embodiment, the inner sleeve diameter may be between approximately 6.68 mm and approximately 7.37 mm. By way of example, the inner sleeve may be one of approximately 6.68 mm, approximately 6.83 mm, approximately 6.93 mm, or approximately 7.37 mm. These measurements are meant to be exemplary, and not limiting. The inner sleeve diameter may be chosen to fit snugly over the outer diameter of an arrow. In one embodiment, the integral sleeve may act to strengthen the front of the arrow and help prevent the arrow from breaking upon impact. In one embodiment, the outer sleeve diameter 1014 is configured to be the same as a distal outer diameter 1025 of an arrow insert. The insert may be secured within the arrow shaft through any manner known in the art. This may include epoxy, glue, or other adhesives used to secure an insert within an arrow shaft. The insert may also be designed to be secured using friction alone. The dimensions shown in FIG. 10 and described herein are meant to be exemplary and not limiting. The arrow insert is dimensioned to best fit within a particular arrow shaft and may be designed for a variety of arrow shafts. The arrow shaft may have any inner diameter that is appropriate for an arrow shaft. The diameter of the insert is designed to fit securely within the arrow shaft. The dimensions may be modified to best fit a particular arrow shaft.

FIG. 10 also shows the bore 1001 set within the distal end of the insert. This bore 1001 is sized to receive a shaft of an arrow point, whether a field point or broadhead. The bore 1001 may comprise a threaded portion 1002 and a smooth portion 1003. The threaded portion 1002 and smooth portion 1003 together may be shaped to receive the shaft of an arrow point, wherein an arrow point may be a field tip, a broadhead, or another type of point designed for an arrow. In one exemplary embodiment, the threaded portion 1002 may be a 8-32 standard threading and may be 12 mm deep from the end of the smooth portion 1003. In another embodiment, the threaded portion 1002 may have a 6-40 thread. In another embodiment, the threading may be configured to fit any threading on an arrow point (whether broadhead or field point). In one exemplary embodiment the smooth portion 1003 may be approximately 11.2 mm deep with an inner diameter of approximately 5.16 mm.

The bore may also comprise a setting 1005 wherein a section of the interior wall of the bore is shaped to receive a frictional retaining mechanism. In one embodiment, the setting 1005 may be a ring around the interior of the bore. In one embodiment the setting 1005 may comprise a section of the bore with an inner diameter greater than that of the smooth portion of the bore. In one exemplary embodiment, the setting may have a diameter of approximately 6.5 mm. In one embodiment, the frictional retaining mechanism may be a ring of any material that will produce friction between the retaining mechanism and the metallic arrow point. The frictional retaining mechanism may be made of plastic, rubber, or another material that produces friction. In one exemplary embodiment, the frictional retaining mechanism comprises an O-ring.

In one embodiment, the setting 1005 and frictional retaining mechanism are set in the bore 1001 at the transition between the threaded portion 1002 and the smooth portion 1003. In one exemplary embodiment the setting 1005 may be between about 0.5 mm and about 4 mm wide. In another exemplary embodiment the setting is about 1.5 mm wide. In yet another exemplary embodiment, the setting is about 3.2 mm wide. The setting may be any size appropriate to fit a given frictional retaining mechanism, and the setting out of specific dimensions is not meant to limit the possible size of the setting other than showing examples of possible sizes to fit a frictional retaining mechanism. The diameter of the setting may be of an appropriate size for the frictional retaining mechanism to securely fit within the setting. The frictional retaining mechanism is sized to fit within the setting. In one exemplary embodiment the setting comprises an area wherein the inner diameter of the bore is expanded from about 5.16 mm to about 6.5 mm.

Figure 11:
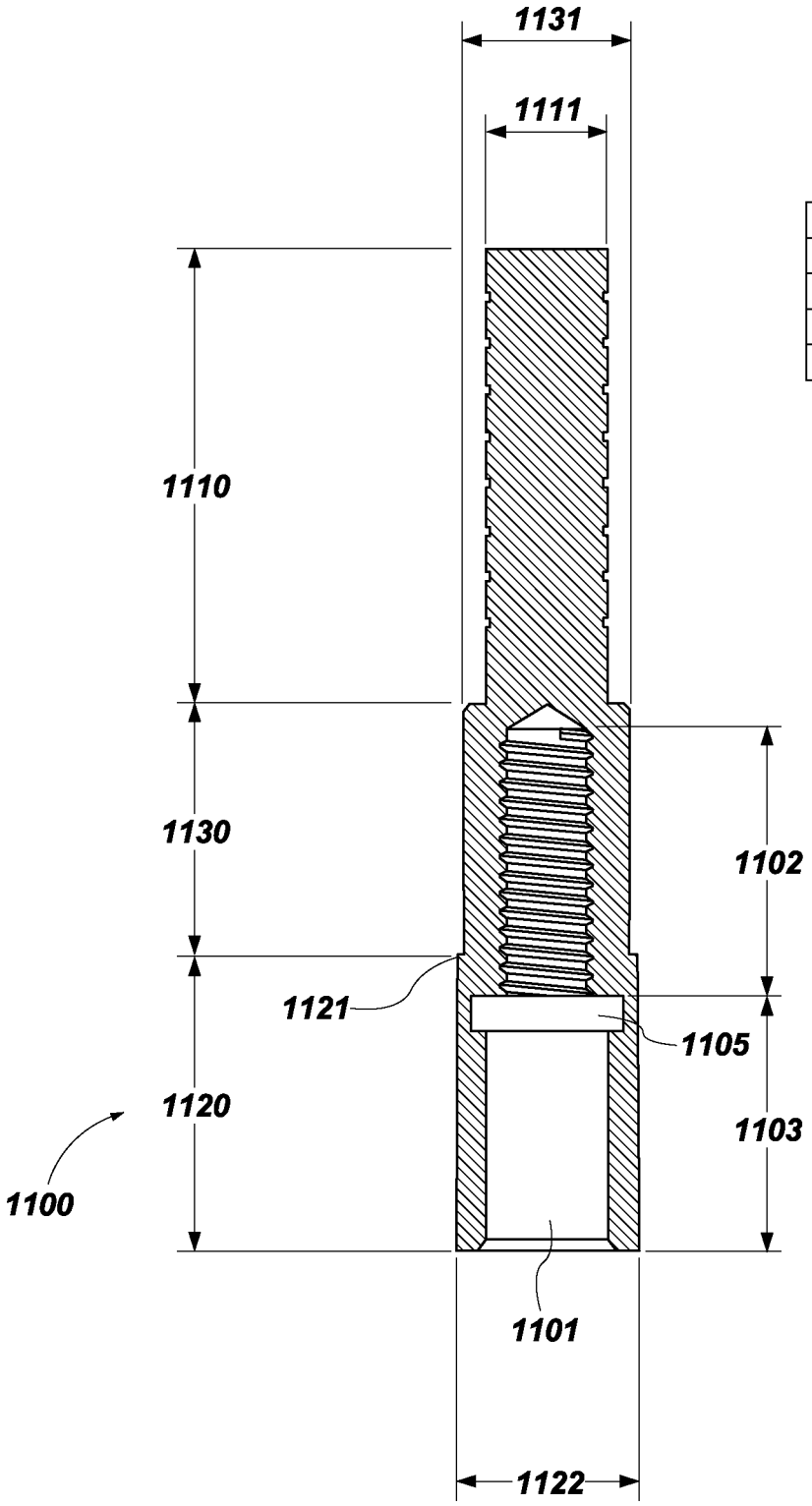
FIG. 11 shows one embodiment of an arrow insert configured to have an arrow sleeve or collar press-fit to the arrow insert.

FIG. 11 shows another embodiment of an arrow insert with frictional retaining mechanism. FIG. 11 shows an arrow insert designed to have a sleeve press fit to the insert. In this embodiment, the arrow insert 1100 has a proximal section 1110, a distal section 1120, and a middle section 1130. In one embodiment, the insert is designed with a proximal diameter 1111 which is configured to fit within the inner diameter of an arrow shaft. In one exemplary embodiment the proximal inner diameter 1111 may be between approximately 5.16 mm and approximately 5.18 mm. In other embodiments, the diameter of the proximal section may be configured to fit within any specific arrow shaft. This may require the proximal section to be greater or smaller than as pictured. In one embodiment the proximal section may have a series of ridges that are designed to receive an adhesive and be secured within an arrow shaft.

In one exemplary embodiment, shown in FIG. 11, the middle section 1130 may have a diameter 1131 of between approximately 6.68 mm and approximately 7.37 mm. In another embodiment, the diameter of the middle section 1131 may be chosen to be equal to the outer diameter of an arrow shaft. In several embodiments, the diameter of the middle section 1131 may be chosen to be approximately 6.68 mm, approximately 6.83 mm, 6.93 mm, or approximately 7.37 mm. In one embodiment, the diameter of the middle section 1131 is chosen to allow a sleeve to be fit over the middle section 1130 and the front portion of an arrow shaft as it is fit over the proximal portion 1110 of an arrow. The diameter of the middle section 1131 may be chosen depending on the type of arrow, as shown in table 1140.

In one exemplary embodiment the distal section may have a front diameter 1122 and a rear diameter, located at the rearmost portion of the distal section 1121. In one embodiment the front diameter 1122 may be approximately 7.95 mm. In one embodiment the rear diameter 1121 may be between approximately 7.28 mm and approximately 7.95 mm, and the diameter of the distal section 1120 may taper from the front diameter 1122 at the front of the arrow insert to the rear diameter at the proximal most portion of the distal section 1121. In one exemplary embodiment the rear diameter of the distal section may be chosen according to the diameter of the middle section, as shown in the table 1140 wherein A is the diameter of the middle section in millimeters 1131 and B is the rear diameter of the distal section in millimeters 1121. By way of example, when the diameter of the middle section is approximately 6.68 mm, the rear diameter of the distal section may be approximately 7.28 mm; when the diameter of the middle section is approximately 6.83 mm, the rear diameter of the distal section is approximately 7.43 mm; when the diameter of the middle section is approximately 6.93 mm, the rear diameter of the distal section is approximately 7.53 mm; when the diameter of the middle section is approximately 7.37 mm, the rear diameter of the distal section is approximately 7.95 mm. In another embodiment, the distal section 1120 of the insert may have a constant diameter throughout the majority of the section and may taper only at the most proximal section of the insert. In one embodiment, the distal section has a constant diameter from the distal edge of the insert for approximately 11.5 mm, while the tapered portion is approximately 1.5 mm long.

FIG. 11 also shows a bore 1101 set within the distal end of the insert. This bore 1101 is sized to receive a shaft of an arrow point, whether a field point or broadhead. The bore 1101 may comprise a threaded portion 1102 and a smooth portion 1103. The threaded portion 1102 and smooth portion 1103 together may be shaped to receive the shaft of an arrow point, wherein an arrow point may be a field tip, a broadhead, or another type of point designed for an arrow. In one exemplary embodiment, the threaded portion 1102 may be a 8-32 standard threading and may be 12 mm deep from the end of the smooth portion 1103. In another embodiment, the threaded portion 1102 may have a 6-40 thread. In another embodiment, the threading may be configured to fit any threading on an arrow point (whether broadhead or field point). In one exemplary embodiment the smooth portion 1103 may be approximately 11.2 mm deep with an inner diameter of approximately 5.16 mm.

The bore may also comprise a setting 1105 wherein a section of the interior wall of the bore is shaped to receive a frictional retaining mechanism. In one embodiment, the setting 1105 may be a ring around the interior of the bore. In one embodiment the setting 1105 may comprise a section of the bore with an inner diameter greater than that of the smooth portion of the bore. In one exemplary embodiment, the setting may have a diameter of approximately 6.5 mm. In one embodiment, the frictional retaining mechanism may be a ring of any material that will produce friction between the retaining mechanism and the metallic arrow point. The frictional retaining mechanism may be made of plastic, rubber, or another material that produces friction. In one exemplary embodiment, the frictional retaining mechanism comprises an O-ring.

In one embodiment, the setting 1105 and frictional retaining mechanism are set in the bore 1101 at the transition between the threaded portion 1102 and the smooth portion 1103. In one exemplary embodiment the setting 1105 may be between about 0.5 mm and about 4 mm wide. In another exemplary embodiment the setting is about 1.5 mm wide. In yet another exemplary embodiment, the setting is about 3.2 mm wide. The setting may be any size appropriate to fit a given frictional retaining mechanism, and the setting out of specific dimensions is not meant to limit the possible size of the setting other than showing examples of possible sizes to fit a frictional retaining mechanism. The diameter of the setting may be of an appropriate size for the frictional retaining mechanism to securely fit within the setting. The frictional retaining mechanism is sized to fit within the setting. In one exemplary embodiment the setting comprises an area wherein the inner diameter of the bore is expanded from about 5.16 mm to about 6.5 mm.

Figure 12:
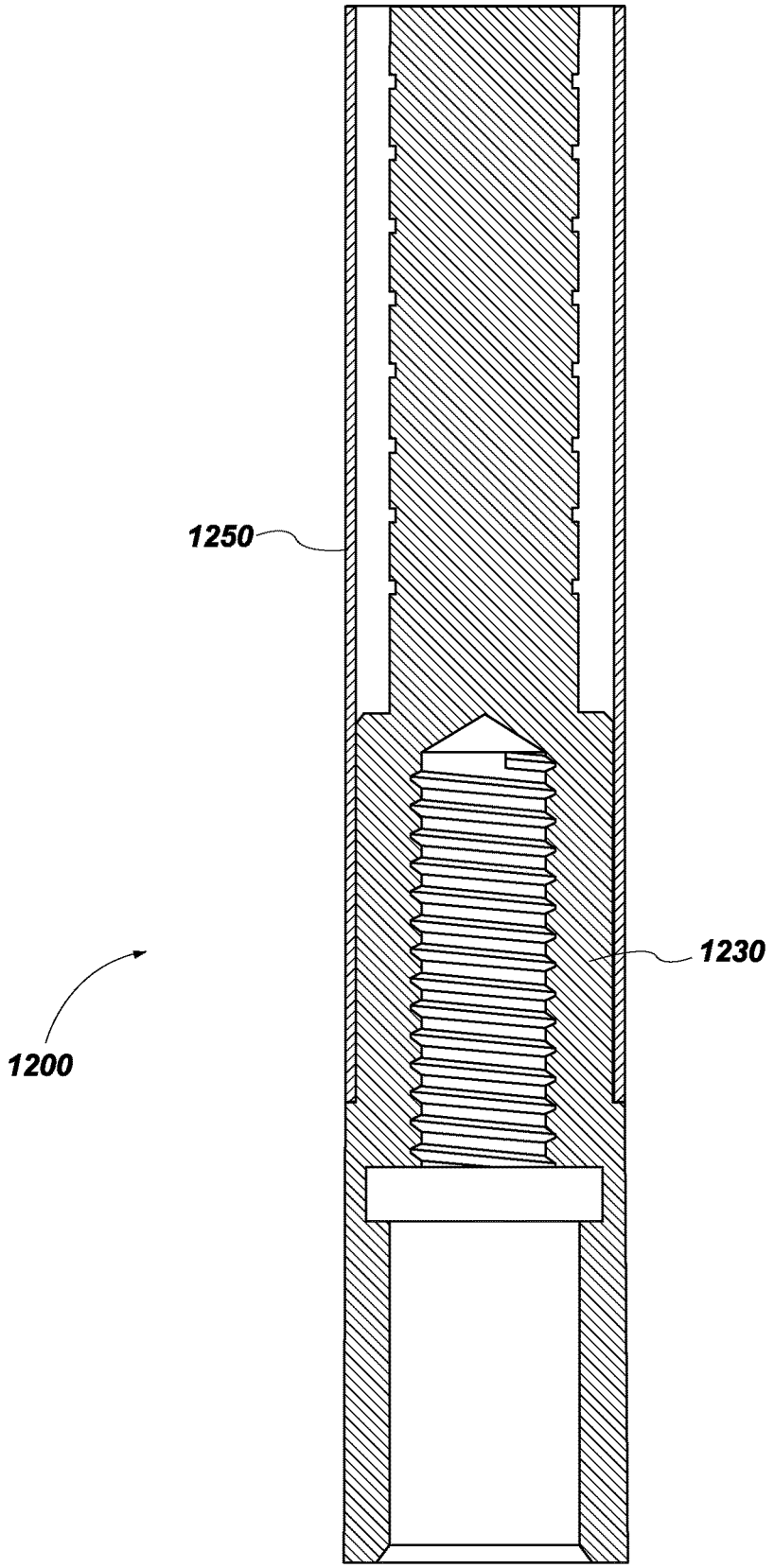
FIG. 12 shows an arrow insert configured to have an arrow sleeve or collar press-fit to the arrow insert also showing the sleeve press fit to the arrow insert.

FIG. 12 shows one embodiment of an arrow insert with frictional retaining mechanism configured to have a sleeve press fit onto the middle section 1230 of the arrow insert. The sleeve 1250 may be configured to be press fit to the middle section of the arrow insert 1200. In one embodiment, the sleeve 1250 may be configured to fit over the middle section 1230 of the arrow insert and the distal portion of a shaft of an arrow. The sleeve may have a length which is configured to be between approximately 31 mm and approximately 100 mm. In various embodiments the length of the sleeve is chosen to be one of approximately 31 mm, approximately 50 mm, approximately 75 mm, or approximately 100 mm. In one embodiment, the sleeve may have an outer diameter which is chosen to allow the sleeve to be rested upon the arrow rest of a bow and fired from a bow configured to fire an arrow without the sleeve attached. In one embodiment this is done by choosing the outer diameter of the sleeve to raise the arrow sufficiently off the arrow rest and raise the trajectory of the arrow so that the arrow hits the target where it would have without the raised trajectory and extra weight. In one embodiment the raised trajectory compensates for the additional weight.

Figure 13A:
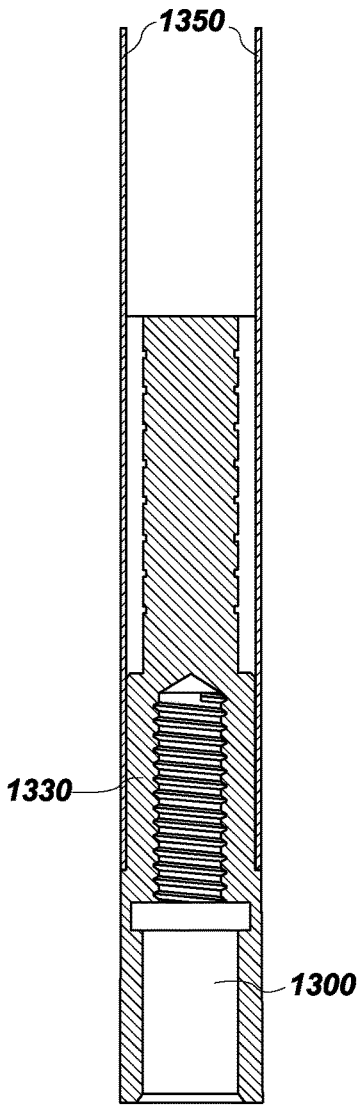
FIG. 13A shows an arrow insert configured to have an arrow sleeve or collar press-fit to the arrow insert, showing an exemplary sleeve that extends along the shaft of an arrow beyond the length of the arrow insert.
Figure 13B:
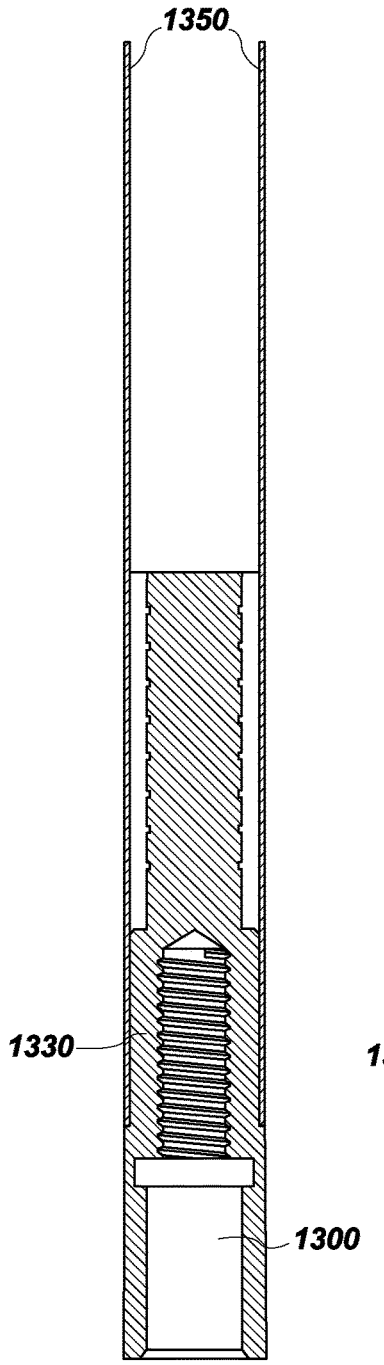
FIG. 13B shows an arrow insert configured to have an arrow sleeve or collar press-fit to the arrow insert, showing an exemplary sleeve that extends along the shaft of an arrow beyond the length of the arrow insert, showing a longer sleeve than in 13A.
Figure 13C:
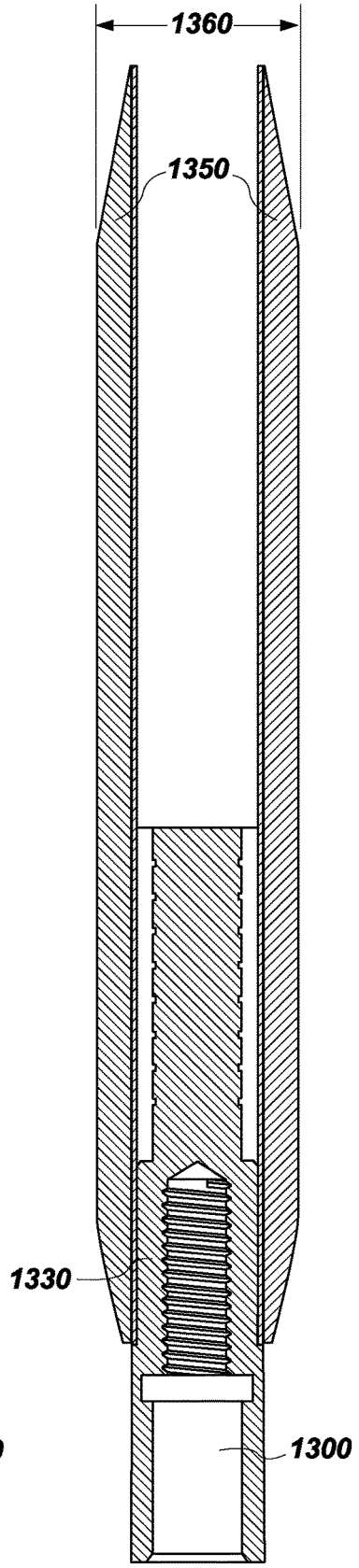
FIG. 13C shows an arrow insert configured to have an arrow sleeve or collar press-fit to the arrow insert, showing an exemplary sleeve that extends along the shaft of an arrow beyond the length of the arrow insert.

The sleeve shown in FIG. 12 is meant to be exemplary and not limiting. FIG. 13 shows that the sleeve may have a variety of lengths. FIG. 13A shows a sleeve 1350 attached to an arrow insert 1300 by being press fit to the middle section 1330 of the arrow insert. In FIG. 13A the sleeve is shown extending beyond the arrow insert. Generally the sleeve will extend beyond the length of the arrow insert, and can extend a variety of distances, as shown in FIG. 13B and FIG. 13C. In one embodiment, the length of the sleeve may correspond to a desired additional weight to be added to the arrow, wherein a longer sleeve provides a greater additional weight to the arrow. In one embodiment, a longer arrow sleeve may add more weight to the arrow than a shorter arrow sleeve. The arrow insert 1300 is inserted and secured within the distal end of an arrow shaft, while the sleeve is fitted on top. In another embodiment, shown in FIG. 13C, the arrow sleeve 1350 may be configured to add weight to the distal end of the arrow as well as protecting the arrow shaft. In one embodiment, the arrow sleeve which adds weight may be configured to compensate for the additional weight. The arrow sleeve may have an outer diameter 1360 which raises the trajectory of the arrow when it is rested on the arrow rest. The arrow sleeve 1300 is configured to have sufficient length to rest it upon the arrow rest when the arrow is fired, and the arrow sleeve raises the trajectory of the arrow a sufficient amount to compensate for the additional weight added to the arrow and allow the arrow to be fired accurately with a bow sighted to fire an arrow without the additional weight. The dimensions shown in FIG. 13 are meant to be exemplary, and the length and diameter of the arrow sleeve may vary as is needed to add weight and adjust the trajectory of the arrow.

Another embodiment of the instant invention may comprise an arrow shaft with a bore set in the distal end of the arrow. In one embodiment the bore is un-threaded at first, then is threaded as it goes further into the arrow shaft. In one embodiment the bore is designed to receive the shaft of an arrow point, whether field point or broadhead. In one embodiment, one or more frictional retaining mechanisms are set in the threaded bore, such that the one or more frictional retaining mechanisms secure the field point or broadhead and prevent the arrow point so that it does not loosen after being fired. In one embodiment the frictional retaining mechanisms are set within settings that are manufactured within the bore. The frictional retaining mechanisms may comprise a ring formed out of plastic, rubber, or other material that causes friction with a metallic arrow point shaft and prevents the arrow point shaft from loosening, allowing the user to take multiple shots without retightening the arrow point and keeps the arrow point securely within the arrow insert.

In the foregoing Detailed Description, various features of the disclosure are grouped together in a single embodiment for the purpose of streamlining the disclosure. This method of disclosure is not to be interpreted as reflecting an intention that the claimed disclosure requires more features than are expressly recited in each claim. Rather, as the following claims reflect, inventive aspects lie in less than all features of any single foregoing disclosed embodiment. Thus, the following claims are hereby incorporated into this Detailed Description by this reference, with each claim standing on its own as a separate embodiment of the disclosure.

It is to be understood that the dimensions described in this application are meant to be exemplary and not limiting. The particular dimensions for a given insert, frictional retaining device, or the setting for the frictional retaining device may be modified as required to fit within a particular arrow shaft or to allow a particular arrow point to fit without departing from the essence of the disclosure.

It is to be understood that the above-described arrangements are only illustrative of the application of the principles of the disclosure. Numerous modifications and alternative arrangements may be devised by those skilled in the art without departing from the spirit and scope of the disclosure and the appended claims are intended to cover such modifications and arrangements. Thus, while the disclosure has been shown in the drawings and described above with particularity and detail, it will be apparent to those of ordinary skill in the art that numerous modifications, including, but not limited to, variations in size, materials, shape, form, function and manner of operation, assembly and use may be made without departing from the principles and concepts set forth herein.

What is claimed is:

1. An arrow insert, comprising:

an outer diameter configured to fit within an inner diameter of an arrow shaft;

a bore configured to receive a shaft of an arrow point, wherein the bore comprises a threaded portion and a smooth portion;

one or more frictional retaining mechanisms set within the bore; and wherein the arrow insert also comprises a setting formed in an interior wall of the bore at a transition between the threaded portion of the bore and the smooth portion of the bore to secure one of the one or more frictional retaining mechanisms, wherein the setting comprises a ring around the interior wall of the bore which has a greater diameter than the smooth portion of the bore.

2. The arrow insert of claim 1 also comprising two or more frictional retaining mechanisms set within the bore.

3. The arrow insert of claim 1 wherein the one or more frictional retaining mechanisms set within the bore secure a threaded shaft of an arrow point and prevent the arrow point from loosening upon an arrow being fired.

4. The arrow insert of claim 1 wherein the threaded portion of the bore is configured to receive a threaded shaft of an arrow point.

5. The arrow insert of claim 1 wherein the bore has an inner diameter of approximately 5.16 millimeters.

6. The arrow insert of claim 1 wherein the setting comprises a ring around the interior wall of the bore has an inner diameter of approximately 6.5 mm.

7. The arrow insert of claim 1 wherein one of the one or more frictional retaining mechanisms comprises a ring of plastic or rubber secured in the setting within the bore.

8. The arrow insert of claim 1 wherein the one or more frictional retaining mechanisms comprise one or more O-rings.

9. The arrow insert of claim 1 wherein the outer diameter of the arrow insert is between about six and about eight millimeters.

10. The arrow insert of claim 1 wherein the outer diameter of the arrow insert is between about 7.6 and about 7.7 millimeters.

11. The arrow insert of claim 1 also configured to have a sleeve placed over the arrow shaft and the arrow insert so that an arrow point secured to the arrow insert also secures the sleeve to the arrow shaft.

12. The arrow insert of claim 11, wherein the sleeve comprises a proximal bore at a proximal end of the sleeve to receive the arrow shaft and a narrower distal bore at a distal end of the sleeve which allows the shaft of the arrow point to pass through and be secured within the bore in the arrow insert, wherein the narrower distal bore at the distal end of the sleeve is sufficiently narrow that the arrow shaft cannot pass through it, but the shaft of the arrow point can pass through and be secured within the arrow insert, thus securing the sleeve to the arrow shaft and the arrow insert.

13. A method of securing an arrow point to a shaft of an arrow, said method comprising;

securing an insert within the shaft of an arrow, wherein said insert comprises:

a bore configured to receive a shaft of an arrow point wherein the bore comprises a threaded portion and a smooth portion;

one or more frictional retaining mechanisms set within the bore; and, wherein the insert also comprises a setting formed in an interior wall of the bore at a transition between the threaded portion of the bore and the smooth portion of the bore to secure one of the one or more frictional retaining mechanisms, wherein the setting comprises a ring around the interior wall of the bore which has a greater diameter than the smooth portion of the bore; and securing an arrow point into the insert by securing the shaft of the arrow point within the bore of the insert.

14. The method of claim 13 wherein the insert comprises two or more frictional retaining mechanisms set within the bore.

15. The method of claim 13 wherein the one or more frictional retaining mechanisms are set within the bore comprise one of wood, rubber, or plastic.

16. The method of claim 13 wherein the one or more frictional retaining mechanisms comprise O-rings.

17. The method of claim 13 wherein the arrow point is secured into the bore of the insert by securing a threaded portion of the shaft of the arrow point to the threaded portion of the bore.

18. The method of claim 13 wherein the threaded portion of the bore is configured to receive a threaded shaft of an arrow point.

19. The method of claim 13 also comprising securing a sleeve over the insert and the shaft of the arrow.

20. The method of claim 19 wherein the sleeve is secured over the insert and the shaft of the arrow by securing the arrow point into the insert by securing the shaft of the arrow point within the bore of the insert through a distal bore in the distal end of the arrow sleeve, wherein the bore in the distal end of the arrow sleeve is small enough that the arrow shaft cannot pass through, but large enough that the shaft of the arrow point can pass through and secure it over the insert and the shaft of the arrow.

21. A two piece arrow insert comprising:

a top piece comprising a cylinder with a bore configured to receive a bottom piece;

a bottom piece comprising a threaded bore;

wherein the top piece and bottom piece comprise a mechanism for securing the bottom piece within the top piece;

wherein the top piece and bottom piece are secured to each other and are configured to fit within an inner diameter of an arrow shaft; and, wherein one or more frictional retaining mechanisms are set within a bore of the secured top and bottom pieces, wherein the bore of the secured top and bottom pieces form a threaded portion and a smooth portion; and wherein the arrow insert also comprises a setting formed in an interior wall of the bore at a transition between the threaded portion and the smooth portion of the secured bore to secure one of the one or more frictional retaining mechanisms, wherein the setting comprises a ring around the interior wall of the secured bore which has a greater diameter than the smooth portion of the secured bore.

22. The two piece arrow insert of claim 21 wherein the mechanism for securing the bottom piece within the top piece comprises a lip on the bottom piece which is received into a groove in the top piece.

23. The two piece arrow insert of claim 21 wherein the mechanism for securing the bottom piece within the top piece comprises threading on an inner diameter of the top piece and on an outer diameter of the bottom piece such that the top and bottom pieces can be threadedly engaged with each other.

24. The two piece arrow insert of claim 21 wherein the mechanism for securing the bottom piece within the top piece comprises an adhesive.

25. The two piece arrow insert of claim 21 wherein the one or more frictional retaining mechanisms is placed on a top of the bottom piece and secured within the top piece.

26. The two piece arrow insert of claim 21 also configured to have a sleeve placed over a top of an arrow and the arrow insert so that an arrow point secured to the arrow insert also secures the sleeve to the arrow.

27. The two piece arrow insert of claim 26 wherein the sleeve comprises a proximal bore at a proximal end of the sleeve to receive a shaft of an arrow and a narrower distal bore at a distal end of the sleeve which allows the shaft of the arrow point to pass through and be secured within the bore in the insert, wherein the narrower bore at the distal end of the sleeve is sufficiently narrow that the arrow shaft cannot pass through it, but the shaft of the arrow point can pass through and be secured within the arrow insert, thus securing the sleeve to the arrow shaft and arrow insert.

28. An arrow insert with a frictional retaining mechanism comprising:

an outer diameter configured to fit within an inner diameter of a shaft of an arrow;

a bore configured to receive a shaft of an arrow point, wherein the bore comprises a threaded portion and a smooth portion, and wherein the bore comprises a setting formed in an interior wall of the bore at a transition between the threaded portion of the bore and the smooth portion of the bore, the setting comprising a ring around the interior wall of the bore, the ring comprising a section of the bore with an inner diameter greater than that of the smooth portion of the bore, wherein the ring has an inner diameter of approximately 6.5 mm and is between about 0.5 mm and about 4 mm wide;

one or more frictional retaining mechanisms set within the bore, wherein one of the one or more frictional retaining mechanisms comprises an O-ring made of plastic or rubber secured in the setting within the bore; and, wherein the arrow insert is configured to have an arrow sleeve placed over the arrow shaft and the arrow insert so that an arrow point secured to the arrow insert also secures the arrow sleeve to the arrow shaft, wherein the arrow sleeve is secured over the insert and the shaft of the arrow by securing the shaft of the arrow point within the bore of the insert through a narrower distal bore in a distal end of the arrow sleeve, wherein the narrower distal bore at the distal end of the arrow sleeve is sufficiently narrow that the arrow shaft cannot pass through it, but the shaft of the arrow point can pass through and be secured within the arrow insert, thus securing the arrow sleeve to the arrow shaft and the arrow insert, and wherein the arrow sleeve is secured to the arrow shaft only by the arrow point.

29. The arrow insert of claim 28 comprising at least two frictional retaining mechanisms set within the bore.

30. The arrow insert of claim 28 wherein the one or more frictional retaining mechanisms set within the bore secure a threaded shaft of an arrow point and prevent the arrow point from loosening upon an arrow being fired.

31. The arrow insert of claim 28 wherein the threaded portion of the bore is configured to receive a threaded shaft of an arrow point.

32. The arrow insert of claim 28 wherein the bore in the arrow insert has an inner diameter of approximately 5.16 millimeters.

33. The arrow insert of claim 28 wherein the ring in the bore has an inner diameter of approximately 6.5 mm.

34. The arrow insert of claim 28 wherein one of the one or more frictional retaining mechanisms comprises a ring of plastic or rubber secured in the setting within the bore.

35. The arrow insert of claim 28 wherein one of the one or more frictional retaining mechanisms comprise one or more O-rings.

36. The arrow insert of claim 28 wherein the outer diameter of the arrow insert is between about six and about eight millimeters.

37. The arrow insert of claim 28 wherein the outer diameter of the arrow insert is between about 7.6 and about 7.7 millimeters.

38. An arrow insert with integrated arrow sleeve comprising:

an outer diameter configured to fit within an inner diameter of an arrow shaft;

a sleeve configured to fit over an outer diameter of an arrow shaft;

a bore configured to receive a shaft of an arrow point, wherein the bore comprises a threaded portion and a smooth portion;

one or more frictional retaining mechanisms set within the bore; and, wherein the arrow insert also comprises a setting formed in an interior wall of the bore at a transition between the threaded portion of the bore and the smooth portion of the bore to secure one of the one or more frictional retaining mechanisms, wherein the setting comprises a ring around the interior wall of the bore which has a greater diameter than the smooth portion of the bore, and wherein the sleeve is integral with the arrow insert.

39. The arrow insert of claim 38 also comprising two or more frictional retaining mechanisms set within the bore and wherein the sleeve is smooth on an outside surface.

40. The arrow insert of claim 38 wherein the one or more frictional retaining mechanisms set within the bore secure a threaded shaft of an arrow point and prevent the arrow point from loosening upon being fired.

41. The arrow insert of claim 38 wherein the threaded portion of the bore is configured to receive a threaded shaft of an arrow point.

42. An arrow insert with a frictional retaining mechanism comprising:

a distal section comprising a bore configured to receive a shaft of an arrow point, wherein the bore comprises a threaded portion and a smooth portion, and wherein the bore comprises a setting formed in an interior wall of the bore at a transition between the threaded portion of the bore and the smooth portion of the bore, the setting comprising a ring around the interior wall of the bore, the ring comprising a section of the bore with an inner diameter greater than that of the smooth portion of the bore, wherein the ring has an inner diameter of approximately 6.5 mm and is between about 0.5 mm and about 4 mm wide;

a middle section configured to have a sleeve placed over a shaft of an arrow and the arrow insert so that an arrow point secured to the arrow insert also secures the sleeve to the shaft of the arrow;

one or more frictional retaining mechanisms set within the bore, wherein one of the one or more frictional retaining mechanisms comprises an O-ring made of plastic or rubber secured in the setting within the bore; and, a proximal section configured to be received into the shaft of the arrow.

43. The arrow insert of claim 42 comprising at least two frictional retaining mechanisms set within the bore.

44. The arrow insert of claim 42 wherein the one or more frictional retaining mechanisms set within the bore secure a threaded shaft of an arrow point and prevent the arrow point from loosening upon an arrow being fired.

45. The arrow insert of claim 42 wherein the threaded portion of the bore is configured to receive a threaded shaft of the arrow point, wherein the threaded portion of the bore includes a tapered lead-in to facilitate alignment during insertion.

46. The arrow insert of claim 42 wherein the sleeve is secured to the shaft of the arrow only by the arrow point.

47. The arrow insert of claim 46 wherein the sleeve comprises a proximal bore at a proximal end of the sleeve to receive a shaft of an arrow and a narrower distal bore at a distal end of the sleeve which allows the shaft of the arrow point to pass through and be secured within the bore in the arrow insert, wherein the narrower distal bore at the distal end of the sleeve is sufficiently narrow that the shaft of the arrow cannot pass through it, but the shaft of the arrow point can pass through and be secured within the arrow insert, thus securing the sleeve to the shaft of the arrow and the arrow insert.

* * * * *